US006159089A

United States Patent [19]

Amin et al.

[11] Patent Number: 6,159,089

[45] Date of Patent: Dec. 12, 2000

[54] GRINDING SYSTEM

[75] Inventors: Rajul Amin, Northborough; Joseph Mielinski, Charlton; Glenn R. Knowlton, Sterling, all of Mass.

[73] Assignee: Norton Company, Worcester, Mass.

[21] Appl. No.: 09/303,213

[22] Filed: Apr. 30, 1999

Related U.S. Application Data

[63] Continuation-in-part of application No. 09/212,713, Dec. 16, 1998, Pat. No. 6,077,156.

[51] Int. Cl.[7] ..... B23F 21/03

[52] U.S. Cl. ..... 451/548; 125/15

[58] Field of Search ..... 451/490, 508, 451/526, 538, 539, 6, 342, 359, 449; 125/15

[56] References Cited

U.S. PATENT DOCUMENTS

| | | | |
|---|---|---|---|
| 3,191,351 | 6/1965 | Balz | 451/508 |
| 4,021,969 | 5/1977 | Davis | 451/6 |
| 5,605,501 | 2/1997 | Wiand | 451/526 |
| 5,697,359 | 12/1997 | Okanishi et al. | 451/449 |
| 6,077,156 | 6/2000 | Amin et al. | 51/548 |

FOREIGN PATENT DOCUMENTS

| | | | |
|---|---|---|---|
| 2207626 | 2/1989 | United Kingdom | 451/490 |

*Primary Examiner*—M. Rachuba
*Attorney, Agent, or Firm*—David Bennett

[57] ABSTRACT

The invention describes an abrasive system comprising a fiber-backed abrasive disc and a backup pad in which the backup pad has spaced portions removed from the circumference such that the disc overlaps in the area of the removed portions. This has the effect of inhibiting catching of the disc on obstructions and enabling easy swarf removal during operation.

9 Claims, 3 Drawing Sheets

GRINDING SYSTEM

This is a Continuation-in-part of Ser. No. 09/212,713, filed on Dec. 16, 1998 U.S. Pat. No. 6,077,156.

BACKGROUND OF THE INVENTION

The present invention relates to grinding systems, particularly those intended for use with angle grinders. Typical grinding discs comprise a substrate or backing material upon which is deposited a maker coat which is used to adhere a coating of abrasive particles applied to the maker coat before it is cured. A size coat is conventionally applied over the abrasive particles to ensure that they are firmly anchored. A supersize coat may be applied over the size coat to confer added properties such as anti-loading, lubrication, grinding aids and the like. More recently other grinding surfaces have been provided in which the abrasive particles are dispersed within a binder which is then deposited on the substrate such that the abrasive material is made in a single step. This binder/abrasive layer may be deposited in a continuous layer that may be smooth or engineered to have a profiled surface with spaced abrading points. Alternatively it may be deposited in isolated islands leaving a profiled surface which also provides spaced abrading points. Such profiled surfaces are very suitable for fine finishing and polishing especially when the particle are small, such as below about 150 microns in average particle size. Such grinding discs are supported on a backup pad which, together with the disc, forms the grinding system as the term is used in this invention.

The drawback of the traditional round abrading disc is that it is not possible to see the surface that is being ground such that it is necessary to grind and then remove to view the surface before grinding again and removing again to view the results. In addition the typical grinding process using conventional discs uses the disc with an attack angle to the workpiece surface of about 45 degrees. This results in gouging unless the operator is quite skilled. These problems were overcome in the invention described in PCT/US96/19191. The abrasive discs described in this Application comprise circular discs having portions removed from at least three spaced positions around the circumference of the disc and holes through the body of the disc, such that the combination of peripheral gaps and holes allow essentially complete view of the portion of the workpiece being ground as it is being ground. In addition to the increased vision and therefore control of the operation, the disc is designed to be used at a very much lower attack angle of about 15 degrees such that a much higher percentage of the actual disc surface is used. By contrast when operating at the traditional high angle of attack the disc has to be discarded after only the outer half inch or so of the periphery of the disc has been worn out. This translates to a much longer life for the disc along with cooler cutting. Such discs are designed to be carried on a backup pad with similar outline shapes. These are described in PCT/US96/18927.

The portions removed from the disc circumference according to the above specification are not restricted to straight chord segments but could include portions that leave the outer perimeter of the disc with a curved outline. The present invention relates to a particularly preferred outline that confers specific advantages especially when working on a surface that meets a second surface angled upward with respect to the surface being ground. In such situations it is possible for the edge of the disc to snag against the angled surface and perhaps tear the disc. The present invention represents a preferred solution to this situation that significantly reduces the consequences of a contact with such an angled surface.

GENERAL DESCRIPTION OF THE INVENTION

The present invention provides an abrasive system comprising a backup pad and, supported thereon in face to face relationship, a fiber-backed abrasive disc, wherein the backup pad has a maximum radius that is from 95 to 100% of the maximum radius of the abrasive disc and from the circumference of which, at spaced intervals, from three to six segments have been removed such that, in the area of the removed segments, the abrasive disc overlaps the backup pad by an amount that is from 10 to 20% of the maximum radius of the abrasive disc. The importance of this feature is that when the abrasive disc is in use abrading a substrate, swarf is produced. Some of this swarf can be expelled through viewing holes where these are provided, but most is generated with a considerable centrifugal component to its motion making ejection to the side favored. Each area of overlap is a point at which the disc is not held in place by the backup pad and is therefore permitted to flex and provide a route by which the swarf can escape. Providing spaced areas of overlap enables the non-overlapping portion to abrade at full force and intervals of lower force grinding allowing the surface and the disc to cool. So prolonging the life of the disc. It is this episodic disc flexing and consequent opportunity for swarf removal and interrupted grinding, (and hence a cooling interval), that gives the system its unique effectiveness.

In a preferred form the abrasive disc and the backup pad that comprise the abrading system have viewing apertures through which a workpiece surface can be observed as the grinding proceeds. A "viewing aperture" is therefore understood to mean an aperture through one component of the system that, when the disc is mounted upon the backup pad preparatory to abrading a workpiece, is in register with a similar viewing aperture in the other component of the system.

In a preferred form of the abrasive system according to the invention, the system comprises a fiber-backed abrasive disc and a backup pad wherein:

a) the disc has a generally circular configuration with from 3 to 9 viewing apertures in the body of the disc at spaced locations around at least one circle concentric with the disc and having a radius smaller than the radius of the disc; and b) the backup pad is circular with a radius that is from 95 to 100% of that of the abrasive disc and has from 3 to 9 viewing apertures and 3 to 6 equally spaced portions removed from the periphery of the backup pad such that the abrasive disc overlaps the backup pad at such portions by up to 20% of the maximum radius of the abrasive disc when the disc and backup pad are aligned with the viewing apertures on both in register.

A circular abrasive disc has some advantages in reducing the possibility that, when abrading a surface of a body with a complex geometry, the edge of this might catch an angled portion and tear. It does however prevent the area viewed through the viewing apertures from extending to the edge of the disc. For this reason it is often preferred that the abrasive disc have, in addition to the viewing apertures, segments removed from spaced portions of the circumference that correspond in location, but not necessarily in geometry, to those removed from the backup pad.

A further preferred form of the invention which addresses this issue provides an abrasive system comprising a fiber-backed abrasive disc and a backup pad, wherein:

a) the disc has a generally circular configuration with a design direction of rotation when in use, and has from three to six equally spaced portions removed from the circumference of the disc, each such portion having leading and trailing edges defined with respect to the design direction of rotation of the disc, and a length defined by the circumferential distance between the points at which the leading and trailing edges meet the circumference, and wherein the deepest radial penetration of the removed portion into the body of the disc occurs adjacent to the leading edge of each removed portion; and b) the backup pad is a circular disc having an equal number of equally spaced portions removed from the circumference of the backup pad and viewing apertures in the body of the pad, as are present in the abrasive disc, provided that, when the disc and backup pad are aligned with removed spaced portions and viewing apertures in register, the backup pad has a greatest radial dimension that is from 95 to 100% that of the abrasive disc and, within at least some part of each of the points on its circumference where the abrasive disc has spaced removed portions, the disc overlaps the backup pad by a distance that is from 10 to 20% of the disc radius at that point.

For the sake of this invention the term "adjacent to" is intended to convey that the deepest radial penetration into the material of the disc of the portion removed from the periphery of the disc occurs within 20% and more preferably 10%, based on the total circumferential length of the removed portion, of the point at which the leading edge of the removed portion meets the circumference of the disc.

The backup pad is described as having the same number of portions removed from the circumference as are removed from the disc but it is to be understood that these removed portions need not be identical in shape to those removed from the disc itself. They should however be such that, when the disc and the backup pad are aligned with viewing apertures in register, at no point on the circumference of the backup pad is the radius of the pad greater than that of the disc.

Removed portions from the disc or the backup pad can have a generally V-shaped outline, with one leg of the V much longer than the other, but this is preferably modified by rounding the points at which the leading and trailing edges meet the circumference such that the actual edge meet the notional circumference of the disc asymptotically.

The most preferred profile for the removed peripheral portions on an abrasive disc is one in which all angles of the removed portion are rounded such that the circumference presents from three to six "parrot beak" profiles essentially as illustrated in FIG. 1 attached hereto. The elongation of the trailing edge has the effect of making the transition to the full circumference of the disc quite gradual such that there is no corner or angle to catch if the disc should approach and touch a surface set at an angle to the surface being ground. This effect is enhanced even more by rounding even the low angle at which the removed portion approaches the circumference. Even though the chances of snagging at the angle at which the leading edge of the removed portion meets the circumference are quite small, it is advantageous, as indicated above, to round off this angle also and this is a preferred feature of the invention.

As regards the backup pad the preferred form of removed peripheral portion is a simple chord segment such as is illustrated in FIGS. 2 and 3 of the drawings attached hereto. This permits a larger degree of overlap than if the removed portions on the backup pad merely mimicked those on the abrasive disc on a larger scale. In any event since the purpose on the rounded shapes on the disc is to minimize tearing of the disc during use, and since the backup pad is not so susceptible to tearing under these circumstances, there is no advantage in the use of such a complex shape.

The greatest radial depth of the removed portion, (which is intended to indicate the greatest amount of the disc, with respect to its radius at that point, that is removed), preferably represents less than 20% of the greatest radial dimension. More preferably the greatest depth is from 10 to 20% of the greatest radial dimension. With respect to the backup pad such restrictions are not relevant except to the extent they compromise the support required by the disc if it is to perform adequately.

The number of removed portions is from three to six and is preferably from three to five. In general the larger the number, the shallower the preferred depth of penetration into the material of the disc represented by the removed portions. Three removed portions are generally most preferred.

The backup pad and disc are preferably aligned automatically by an aligning means integral with the design of the backup pad and disc. This aligning means can conveniently be provided by use of a non circular mounting aperture located at the centers of both disc and backup pad. Thus, for example, a triangular mounting aperture in both pad and disc and sized to fit on a triangular bushing which in turn is mounted on to the spindle of a rotary grinder can be designed to ensure that the spaced portions removed from the circumferences of backup pad and disc would be appropriately aligned when the disc is mounted on the backup pad. Alternatives to such shaped mounting apertures include a system of pins or bosses cooperating with mounting holes or recesses, and located on opposed surfaces of the backup pad and disc that are in contact when the system is in use.

The use of a clamping mechanism in conjunction with the aligning techniques is a preferred embodiment of the invention but it is understood that the abrasive disc can also be adhered to the backup pad by other conventional techniques including a pressure sensitive adhesive and a "hook and loop" system. This term is used to cover any system in which mechanical engagement of structures on opposed contacting faces holds such faces together in a readily detachable manner. There are many developments from the basic system using hooks engaging with a fleece, (commercialized under the Velcro® name). Where these methods involve mechanical detachable engagement, they are understood to be included within the scope of attachment means that can be used in the practice of this invention. In the case of an adhesive system, one of the contacting surfaces is most preferably treated to adapt it to receive the adhesive, and this is usually accomplished by laminating a film to the backing of the abrasive disc. In the case of a hook and loop system of attachment, each of the contacting surfaces receives one component of the system. In practice this means that both surfaces have to be laminated to a suitable sheet material with the cooperating component on the exposed surface.

DESCRIPTION OF THE PREFERRED EMBODIMENTS

The abrasive surface of the disc can be a conventional surface made by successive applications of maker, abrasive particles, size and optionally supersize layers. However it can also have a profiled surface produced by molding, embossing or gravure printing an abrasive/binder composite deposited on a backing material.

The fiber backing can be made from natural or artificial fibers and included fabrics that have been formed into a coherent sheet material by any conventional process such as knitting, weaving or needle-punching a non-woven fiber assembly. Paper backings are also included in the term "fiber-backed" as it is used in this specification. Typically fiber backing materials need to be pretreated to ensure that the binders placed thereon in the construction of the abrasive disc, (primarily the "maker coat"), are not absorbed into the fiber backing as they are applied and the fiber-backed abrasive discs will be assumed to have received this treatment wherever appropriate or advantageous.

The abrasive grain can be any of those conventionally used to make abrasive discs such as fused or sintered alumina, silicon carbide, fused alumina/zirconia and the like. The binder by which the particles are held can be a phenol/formaldehyde such as is commonly used for most abrasive discs or it could be one of the many other thermally curable substitutes that have been proposed such as urea/formaldehyde resins and epoxy resins. Radiation-curable resins such acrylate-based resins as well as epoxy-urethanes and epoxyacrylates can also be used.

In the preferred embodiments of the invention, it is preferred to provide holes or viewing apertures in the body of the disc so as to provide workpiece surface visibility. The holes can have any shape but, for greatest visibility and least disruption of the abrasive surface of the disc, it is preferred that the holes are round in shape. The holes can however be oval or polygonal if desired provide these do not weaken the structure of the disc. The number of these holes is preferably from 3 to 9 and more preferably 3 to 6. The number of holes is largely determined by the size of the disc. Thus in a 4.5 inch diameter disc, three holes are preferred with the centers of the holes lying on a circle drawn from half to two thirds of the distance from the axis to the circumference of the disc. Larger discs can accommodate up to nine viewing apertures and in such event they can be arrange in groups each group having centers on a circle of a different radius, so as to enlarge the effective amount of the working surface that can be viewed during grinding. As indicated above the location of the holes is preferably such as to increase the visibility of the workpiece surface without diminishing the dimensional stability of the disc under conditions of use or the grinding effectiveness to any unacceptable degree. It is preferred therefore that the holes be located between the portions removed from the circumference and at a radial distance from the center of the disc such that the greatest radial distance of each hole from the center is about the same as the shortest radial dimension of the disc as a result of the removal of a portion of the circumference of the disc. It is preferred that the greatest radial dimension of each hole be less that 30% and more preferably less than 20% of the greatest radial dimension of the disc.

The radius of the disc is not an integral part of the invention. However the most practical applications for such discs require radii of from about 8 cm to 25 cm and most preferably from 11 to 18 cm.

The backup pad often has a shape similar to the disc with which it cooperates to provide the system but this need not imply that the shape mimics that of the disc. In fact in a preferred embodiment the disc has the shape illustrated in FIG. 1 but, as shown in FIG. 2, the backup pad has an equal number of spaced portions removed from the circumference that have the form of straight chord segments. The maximum radius of the backup pad and the disc are within about 5% of one another in this preferred embodiment but the radius in the spaced removed portions is up to 20% shorter for the backup pad than for the disc. The effect is to create regions of overlap of disc beyond the backup pad and this greatly minimizes any tendency of the abrasive disc to catch when accidentally contacted with a surface at an angle to the surface being ground because the disc is able to flex at that point. Additionally such flexing facilitates the discharge of swarf at that point.

DRAWINGS

Figure 1:
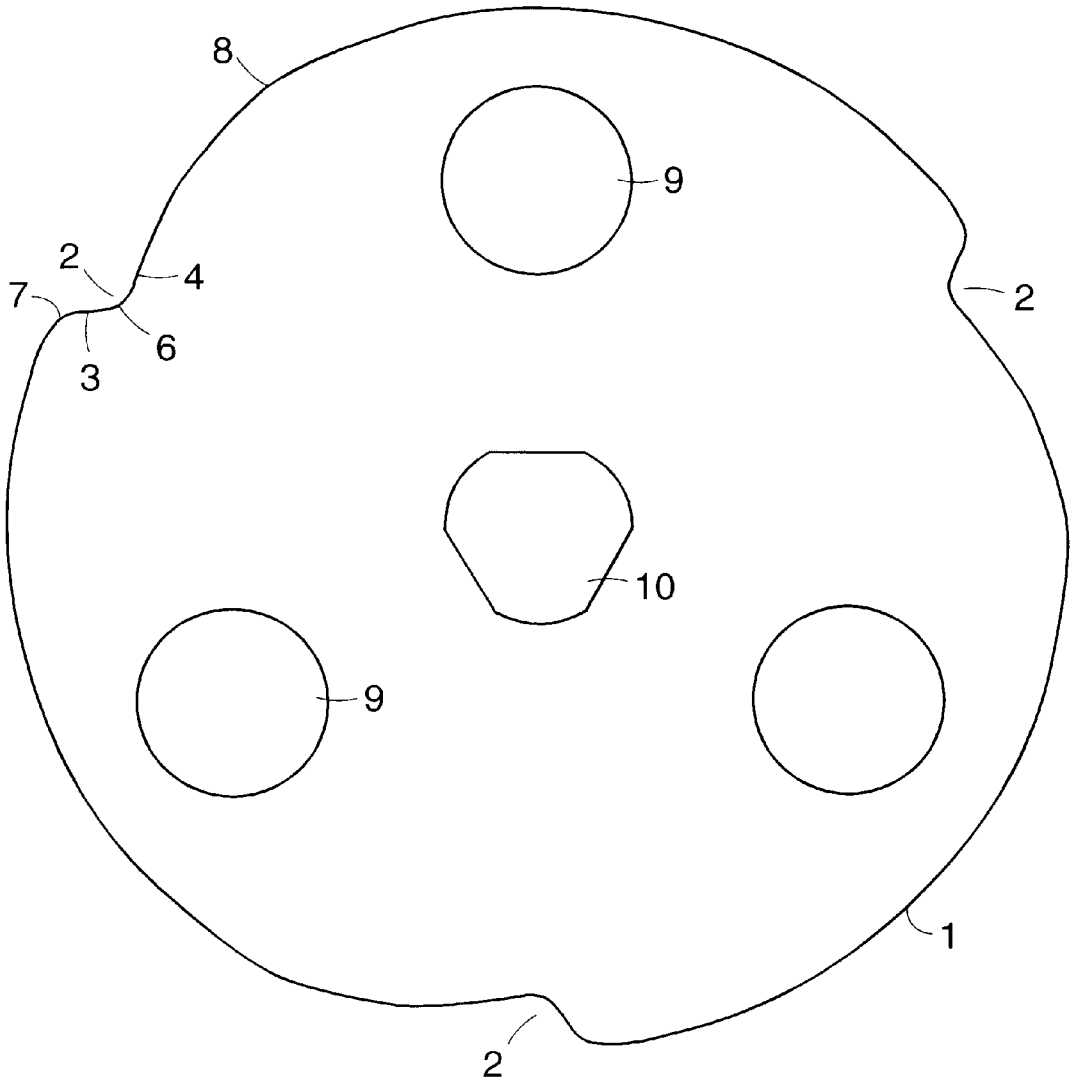
FIG. 1 is an elevation view of a grinding system according to the invention viewing the surface presented to a workpiece when in use. Such a view shows essentially only the disc.
Figure 2:
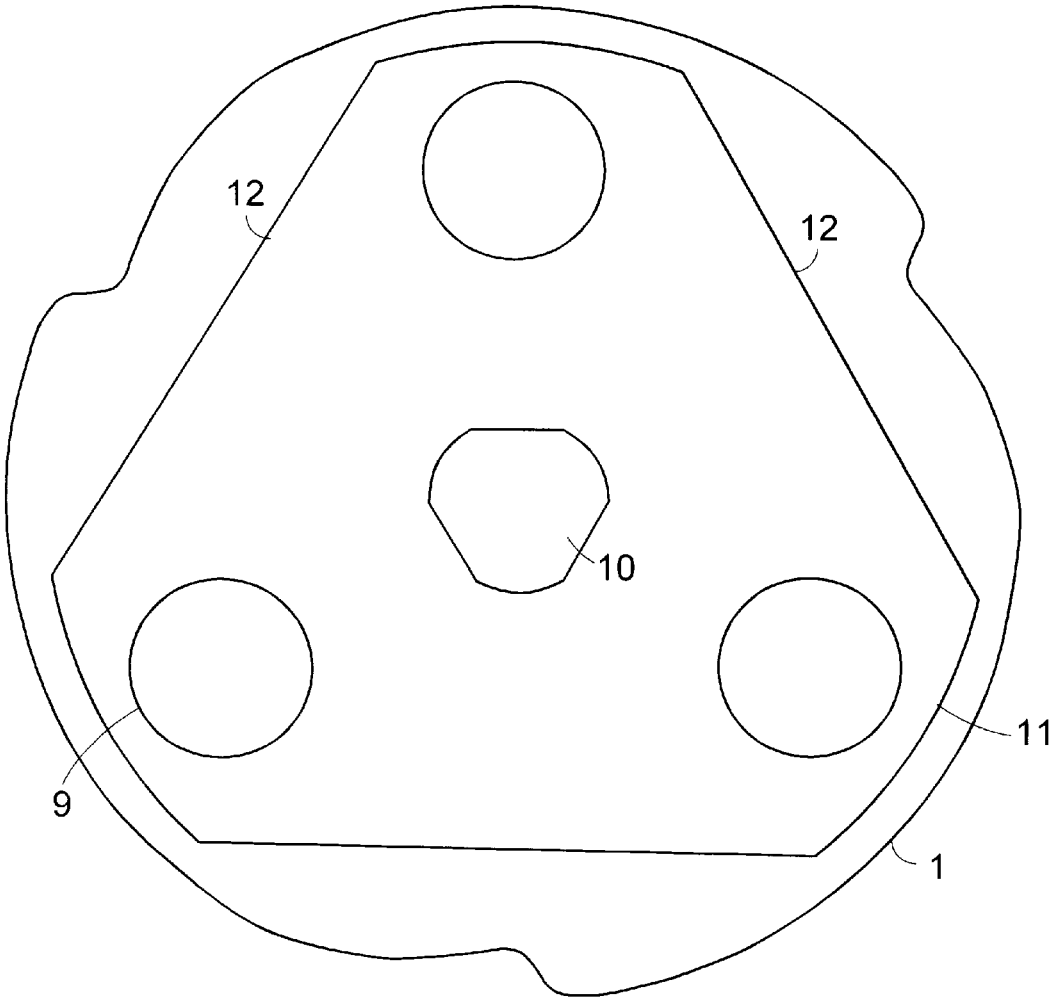
FIG. 2 is an elevation of the opposed surface from that presented in FIG. 1. It shows therefore mainly the backup pad with the disc only in the overlap areas.
Figure 3:
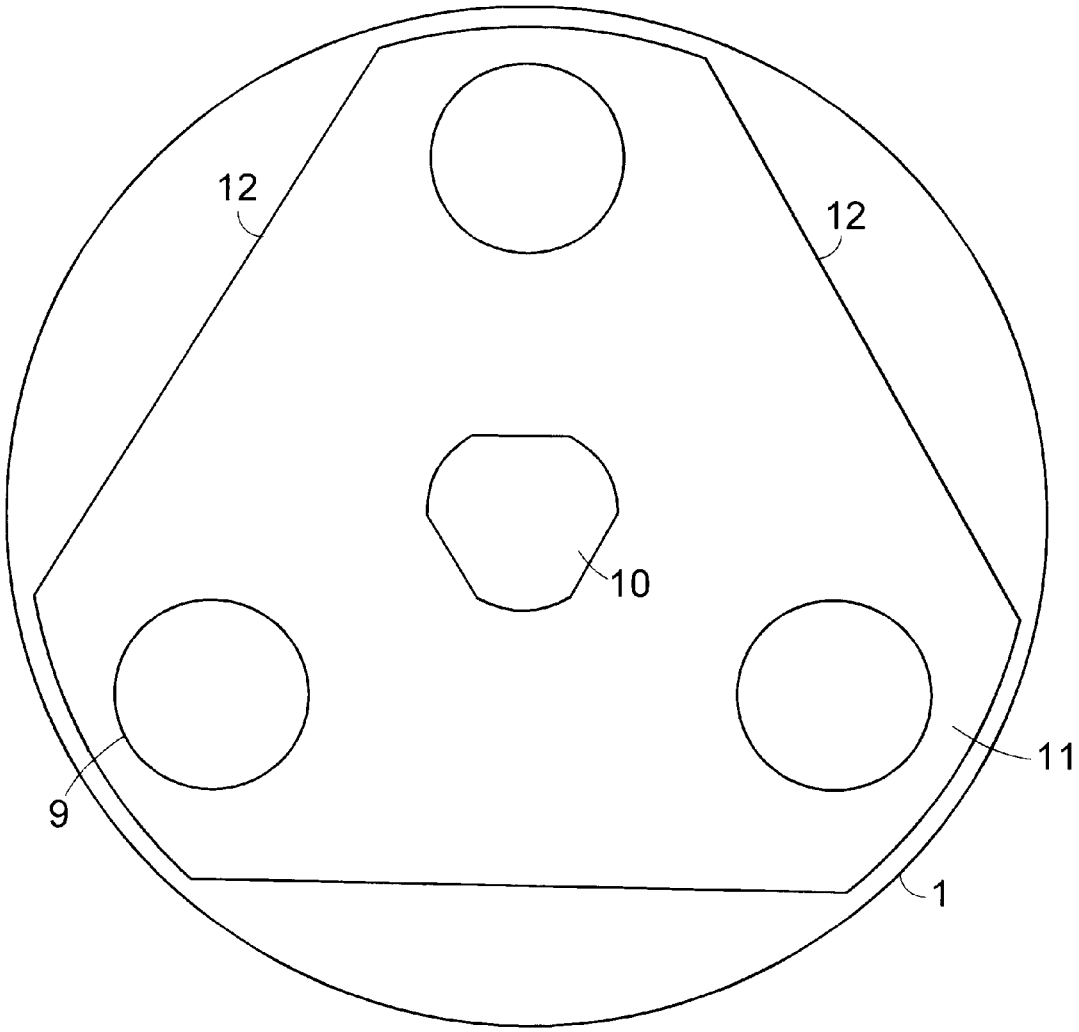
FIG. 3 is similar to FIG. 2 except that the abrasive disc is perfectly circular.

The invention is now further described with reference to the Drawings, which show an abrasive disc, 1, with a generally round configuration with three spaced indentations, 2, remaining after removal of portions of the circumference. The indentations have leading edges, 3, and trailing edges, 4, and a point of greatest depth, 6. The leading and trailing edges each meet the circumference in rounded angles, 7 and 8 respectively, and the point of greatest depth is located adjacent the leading edge such that the distance of point 6 from point 7, measured along the original circumference of the disc, is less than 20% of the circumferential distance separating points 7 and 8.

The disc is also provided with round holes, 9, spaced between the locations of the portions removed from the circumference and at a radial distance from the center of the disc that is less than the shortest radial dimension of the disc after removal of the portions from the circumference.

The disc also has an axially located mounting hole, 10, which, as shown, is shaped to correspond to a mounting bush, (not shown). The shape of the hole corresponds to that in the backup pad, 11, which is also basically a circular disc with three spaced portions, 12, removed from the circumference. While these removed portions can mimic the shape of the portions on the disc, in the illustration in the Drawings the removed portions are straight chord segments of the circumference. In the regions of greatest radial dimension, (where no portion of the disc or backup pad has been removed), the disc overlaps the backup pad by up to about 5 to 10% of the radius of the disc at that point.

Modifications to the features shown in the Drawings could clearly be made without departing from the essential spirit of the invention. All these are included in the invention claimed herein.

What is claimed is:

1. An abrasive system comprising a backup pad and supported thereon a fiberbacked abrasive disc the disc and pad having a common axis of rotation, wherein the backup pad has the shape of a circular disc from the periphery of which, at spaced intervals, from three to six segments have been removed, and the relative dimensions of the abrasive disc and the backup pad are such that the backup pad has a maximum radius that is from 95 to 100% of the maximum radius of the abrasive disc and, in the area of the removed segments, the abrasive disc overlaps the backup pad, and the greatest extent of said overlap is an amount that is from 10 to 20% of the maximum radius of the abrasive disc.

2. An abrasive system according to claim 1, wherein:

a) the disc has from 3 to 9 viewing apertures in the body of the disc at spaced locations around at least one circle concentric with the disc and with a radius smaller than the radius of the disc; and b) the backup pad has from 3 to 9 viewing apertures and the disc and backup pad are aligned with the viewing apertures on both in register.

3. An abrasive system according to claim 2, wherein the disc has from three to six spaced portions removed from the circumference of the disc each removed portion having leading and trailing edges defined with respect to the intended preferred direction of rotation of the disc when in use, and each such removed portion has a length defined by the circumferential distance between the points at which the leading and trailing edges meet the circumference, and wherein the shortest radial dimension of the disc occurs adjacent the leading edge.

4. An abrasive system according to claim 3 wherein the leading and trailing edges of each removed portion on the disc meet the nominal circumference asymptotically.

5. An abrasive system according to claim 1 in which the number of portions removed from the circumference of the backup pad is three.

6. An abrasive system according to claim 2 in which the disc and backup pad are each provided with viewing apertures that are in register when the system is in use and which, in the backup pad, are located between the portions removed from the circumference.

7. An abrasive system according to claim 2 in which the viewing apertures are located so as to provide that, in use, the combined effect of the viewing apertures and the removed portions from the circumference is to permit continuous vision through at least half of the greatest radial dimension of the disc.

8. An abrasive system according to claim 2 in which the backup pad and the disc are provided with alignment means by which a disc can be mounted on the pad such that the viewing apertures in each are in register.

9. An abrasive system according to claim 8 in which the alignment means comprises identical, non-circular, axially located mounting holes.

* * * * *